United States Patent [19]

Donohue

[11] 4,402,805

[45] Sep. 6, 1983

[54] ELECTROCHEMICAL PROCESS TO PREPARE P-HYDROXYMETHYLBENZOIC ACID WITH A LOW LEVEL OF 4-CBA

[75] Inventor: John A. Donohue, Elmhurst, Ill.

[73] Assignee: Standard Oil Company Indiana, Chicago, Ill.

[21] Appl. No.: 358,222

[22] Filed: Mar. 15, 1982

[51] Int. Cl.[3] ..... C25B 3/04

[52] U.S. Cl. ..... 204/75

[58] Field of Search ..... 204/73 R, 75, 59 R

[56] References Cited

U.S. PATENT DOCUMENTS 3,929,613 12/1975 Michelet ..... 204/77

3,984,294 10/1976 Nohe et al. ..... 204/75 X

FOREIGN PATENT DOCUMENTS 2510920 9/1976 Fed. Rep. of Germany ..... 204/75

2642496 3/1978 Fed. Rep. of Germany ..... 204/75

OTHER PUBLICATIONS

L. Eberson, Organic Electrochemistry, Decker, N.Y., (1973), pp. 413–425.

*Primary Examiner*—G. L. Kaplan

*Assistant Examiner*—Nam X. Nguyen

*Attorney, Agent, or Firm*—William C. Clarke; William T. McClain; William H. Magidson

[57] ABSTRACT

Terephthalic acid is electrochemically reduced to p-hydroxymethylbenzoic acid and 4-carboxybenzaldehyde content is decreased by a process in a two-compartment electrolysis cell in which (a) the cathode is solid and metal with a mercury amalgam surface and with a hydrogen overvoltage which is greater than the potential for the reduction of terephthalic acid to p-hydroxymethylbenzoic acid, (b) the separating diaphragm is a cation exchange membrane, (c) the catholyte comprises a solution of terephthalic acid, ammonia, an ammonium salt and a soluble salt of mercury, (d) the temperature of the catholyte is between 0° C. and 100° C., (e) the current density is within the range of 1 to 200 $A/dm^2$, (f) the concentration of the said soluble salt of the mercury metal is within the range of 5 to 500 ppm expressed as the metal, (g) the reduction of terephthalic acid to p-hydroxymethylbenzoic acid is performed at a voltage of about at least 6 volts with current efficiency being maintained at a level of at least 80%, and (h) reduction of 4-carboxybenzaldehyde is performed at a voltage not greater than 4 volts.

20 Claims, No Drawings

ELECTROCHEMICAL PROCESS TO PREPARE P-HYDROXYMETHYLBENZOIC ACID WITH A LOW LEVEL OF 4-CBA

BACKGROUND OF THE INVENTION

This invention relates to p-hydroxymethylbenzoic acid. More particularly, it relates to a process for the preparation of p-hydroxymethylbenzoic acid with a low level of 4-carboxybenzaldehyde. Even more particularly, the invention relates to a process for preparation of p-hydroxymethylbenzoic acid (p-HMBA) by electrochemical reduction of terephthalic acid, to operation of the electrolysis cell by treatment of the cathode to obtain a mercuric overlay as an amalgam on the cathode surface, the addition of a soluble salt of mercury, which regenerates the amalgam overlay, to the electrolysis catholyte solvent, the reduction of the terephthalic acid being performed at a voltage of at least 6 volts with current efficiency being maintained at a level of at least 80%, the reduction of the 4-carboxybenzaldehyde being performed at a voltage of not greater than 4 volts. The process, as a continuous process, is obtained by use of two electrolysis cells in series, wherein p-hydroxymethylbenzoic acid (p-HMBA) containing by-product impurities from one electrolysis cell is transported to a second electrolysis cell for reduction of by-product impurities. In a batch operation, the entire process is obtained in one electrolysis cell.

Numerous methods are known for the preparation of p-hydroxymethylbenzoic acid. Among other methods, some of these are based on the saponification of a corresponding halogenmethyl compound, such as p-chloromethylbenzoic acid or the esters thereof or p-chloromethylbenzonitrile. For example, several methods for the synthesis of p-hydroxymethylbenzoic acid are taught in U.S. Pat. No. 4,130,719. The electrochemical reduction of terephthalic acid to p-hydroxymethylbenzoic acid is taught in commonly-assigned application Ser. No. 319,120, filed Nov. 9, 1981, now U.S. Pat. No. 4,381,229.

p-Hydroxymethylbenzoic acid must be free from by-products when it is to be employed in polycondensation reactions, such as in the preparation of polyesters. However, most of the known processes for the preparation of p-hydroxymethylbenzoic acid do not yield the acid free from by-products. Thus, for example, during the saponification of highly pure p-chloromethylbenzoic acid in a faintly alkaline aqueous medium, up to 10% of dibenzylether-4,4'-dicarboxylic acid is always produced.

In other methods, as for example, in the electrochemical reduction of terephthalic acid to p-hydroxymethylbenzoic acid many competing reactions take place in the electrolysis cell. The resulting presence of 4-carboxybenzaldehyde (4-CBA), dihydroxymethylbenzene, toluic acid and other impurities render the resulting p-hydroxymethylbenzoic acid undesirable for use as a monomer for polymer applications without further expensive purification.

It is well-known that in the cathodic reduction of carboxylic acids that two types of products can result, either the corresponding aldehyde in a two-electron process or the hydroxymethyl compound in a four-electron process where the aldehyde is further reduced to the alcohol. (M. Baizer, *Organic Electrochemistry,* Dekker, N.Y. (1973), 414) The alcohol can be further reduced to the methyl group.

Accordingly, in the preparation of p-hydroxymethylbenzoic acid to obtain the crude acid, many by-products can also be produced, among which are 4-carboxybenzaldehyde, dihydroxymethylbenzene and toluic acid. 4-Carboxybenzaldehyde is a particularly undesirable impurity because it acts as a chain-stopper stopper during polyesterification. Although 4-carboxybenzaldehyde is difficult to remove by physical means, it can be hydogenated to toluic acisd and other derivatives. Toluic acid also acts as a chain-stopper during polyesterification. Toluic acid can be efficiently removed by cooling and crystallizing crude p-hydroxymethylbenzoic acids containing it. 4-Carboxybenzaldehyde also can be hydrogenated to the hydroxymethyl compound, i.e., p-hydroxymethylbenzoic acid, in an electrochemical process as is taught by Baizer, mentioned above, but hydrogenation of terephthalic acid in an electrochemical process results in increased quantities of 4-carboxybenzaldehyde despite the concurrent hydrogenation of 4-carboxybenzaldehyde to p-hydroxymethylbenzoic acid. Accordingly, under the usual conditions used to obtain electrochemical reduction of terephthalic acid to p-hydroxymethylbenzoic acid, the presence of the resulting by-products in the product stream renders the resulting p-hydroxymethylbenzoic acid unfit for polyesterification without further extensive purification.

Accordingly, it is an object of the present invention to develop an electrochemical process for the manufacture of p-hydroxymethylbenzoic acid from terephthalic acid which avoids the aove disadvantage of producing more 4-carboxybenzaldehyde (4-CBA) than is hydrogenated to p-hydroxymethylbenzoic acid, and thus the level of the 4-CBA and other impurities is increased with continued operation. It is an object of the present invention to provide a process for producing of p-hydroxymethylbenzoic acid wherein production of 4-carboxybenzaldehyde, dihydroxymethylbenzene and toluic acid is minimized. It is a further object of this invention to provide a process for electrochemical manufacture of p-hydroxymethylbenzoic acid from terephthalic acid wherein the level of 4-carboxybenzaldehyde in the resulting product is equal to or less than 500 parts per million (ppm). It is a further object of this invention to obtain high current efficiency in the reduction of terephthalic acid to p-hydroxymethylbenzoic acid and to obtain a low level of by-product production, specifically 4-carboxybenzaldehyde, despite high current efficiency obtained in the reduction of terephthalic acid which, in turn, produces a high level of impurities, such as 4-carboxybenzaldehyde, dihydroxybenzene and toluic acid. Other objects will appear hereinafter.

SUMMARY OF THE INVENTION

Terephthalic acid is electrochemically reduced to p-hydroxymethylbenzoic acid in a process in a two-compartment electrolysis cell with a suitable membrane in which (a) the cathode is solid and metal with a mercury overlay as an amalgam surface and has a hydrogen overvoltage which is greater than the potential for the reduction of terephthalic acid to p-hydroxymethylbenzoic acid, (b) sufficient mercury is added as a mercury compound to maintain the process, (c) the reduction of terephthalic acid to p-hydroxymethylbenzoic acid is performed at a voltage of about at least 6 volts with current efficiency being maintained at a level of at least 80%, and (d) the reduction of 4-carboxybenzaldehyde is performed at a voltage not greater than 4 volts. For example, 4-carboxybenzaldehyde is produced from terephthalic acid at voltages greater than 6 volts. The process, as a continuous process, is obtained by use of two electrolysis cells operated in series, wherein p-hydroxymethylbenzoic acid product containing by-product impurities from one electrolysis cell is transported to a second electrolysis cell for reduction of by-product impurities. In a batch operation, the entire process is obtained in one electrolysis cell.

DETAILS OF THE INVENTION

The term "current efficiency" is defined as ratio of consumption in Faradays used to make product to total Faradays used times 100. The term "amalgam" is defined as referring only to an alloy of mercury.

The present invention provides a process for the electrochemical preparation of p-hydroxymethylbenzoic acid with high current efficiency and minimal production of by-product impurities. The process comprises performing the cathodic reduction to obtain the crude terephthalic acid in an electrolysis cell having two compartments, a cathode compartment and an anode compartment. The aode and cathode compartments can be separated by a cation exchange diaphragm, although the presence of a separating diaphragm is not an essential element of the invention. If a separating diaphragm is used, the cathode and anode and the separating diaphragm are preferably in parallel planes. Advantageously, several of the elementary electrolysis cells can be combined in the manner of a filter press.

In general, any metal with a higher hydrogen overvoltage than the potential for the reduction of terephthalic acid to p-hydroxymethylbenzoic acid which will form an alloy with lead and an amalgam with mercury is suitable for the cathode. Examples of material forming the cathode are lead and alloys of lead with cadmium, antimony, tin or bismuth. The cathode is prepared by abrading in a suitable manner the surface of the solid cathode to remove any metal oxidation and then contacting the abraded metallic surface with mercury to form the amalgam. In the case of lead, it is sufficient to abrade the surface of the lead solid to remove all forms of lead oxide and any other impurities. Liquid mercury of 99.9% purity is used as a bath for the abraded solid lead cathode. In the case of lead, the lead amalgam is formed in the surface of the lead at room temperature upon contacting the mercury bath.

The anode of the electrolysis cell usually consists of a solid electrically conducting material which is electrochemically stable in the anolyte and under the operating conditions considered. Examples of such materials are metals and metalloids such as platinum, platinized titanium, graphite, lead and its alloys, particularly with silver, antimony or tin.

Optionally, any known cation exchange membrane can be used to separate the catholyte from the anolyte, but membranes of the homogeneous type are preferred. These membranes optionally can be reinforced with a screen. For carrying out electrolysis operations over a long period, it is naturally preferred to use membranes which do not swell and which are stable to the action of the various constituents of the catholyte and the anolyte. Examples of such membranes are those of Nafion (trademark of E. I. du Pont de Nemours & Co.) perfluorosulfonic acid.

The catholyte can comprise a neutral solvent, a weakly basic solvent or an aprotic solvent, i.e., acetonitrile, to which a source of protons has been added. Examples of neutral solvents are water, methanol and other alcohols mixed with water to obtain necessary solvent properties. Examples of basic solvents are ammonia, methylamine, and ethylenediamine which are diluted suitably to maintain a weak basic condition. In a suitable method of operation, the catholyte consists of a solvent, preferably water, and terephthalic acid with a soluble ammonium salt and ammonia. At the start of electrolysis, the catholyte contains sufficient ammonia to form a diammonium salt of terephthalic acid. Less ammonium salt is required as the electrolysis process proceeds. Concentration of ammonia as ammonium hydroxide is within the range of from about 1 gram of ammonium hydroxide per 2 grams of terephthalic acid to about 1 gram of ammonium hydroxide per gram of terephthalic acid and wherein the pH of the resulting solution is at least 6.5, preferably from about greater than 7.0 to less than 10.0, more preferably within the range of from about 8.0 to about 9.5. The concentrations of terephthalic acid and ammonium salt can be either constant when the reaction is carried out continuously, or variable when the reaction is carried out discontinuously. In all cases, the concentration of terephthalic acid is less than the saturation concentration at the temperature of electrolysis; generally, this concentration is greater than 2% by weight, and preferably greater than 3% when the current density is high, these values relating particularly to the constant concentration when the reaction is carried out continuously and to the final concentration when the reaction is carried out discontinuously. The concentration of ammonium salt is usually between about 0.1% to about 10% by weight, and preferably between about 0.1% to about 1.0% by weight, these values relating particularly to the total solution of water, terephthalic acid and other solution components when the reaction is carried out continuously and to the final solution when the reaction is carried out discontinuously. The ammonium salt can be any ammonium salt, but a salt selected from the group consisting of ammonium chloride, ammonium sulfate, and ammonium carbonate is preferred.

The catholyte will typically also contain reaction by-products in small amounts, generally less than 1% by weight of the catholyte, such as 4-carboxybenzaldehyde, toluic acid, dihydroxymethylbenzene, and ring-reduced cyclic compounds. After the organic compounds are separated from the solvent, these same impurities are about 4 to 5% by weight of the p-HMBA present.

An aqueous acid solution is preferably used as the anolyte, though any other anolyte capable of providing electrical conductivity between the two electrodes can be used. Aqueous solutions of sulphuric or phosphoric acids are usually employed in a concentration generally of 0.1 to 5 mols/liter, and preferably 0.5 to 2 mols/liter.

The current density at the cathode is within the range of from about 1 to about 200 amperes per decimeter squared ($A/dm^2$), preferably from about 20 to about 100 $A/dm^2$.

The flow of the catholyte in a closed circuit is usually achieved by means of a pump. The circuit can, in addition, contain attached devices such as a heat exchanger or an expansion vessel. The expansion vessel enables terephthalic acid to be added to the catholyte and also some catholyte to be withdrawn in order to extract the crude p-hydroxymethylbenzoic acid containing by-products. By-product hydrogen is also removed.

The anolyte can also be circulated, preferably in an anolyte circuit similar to that of the catholyte, so that the pressure on either side of the separating diaphragm can be substantially the same.

At least one spacer is preferably present in the anode and cathode compartment if a cation exchange membrane is used. These spacers serve to prevent deformations of the cation exchange membrane and prevent contact between this membrane and the electrodes. These spacers also help to render uniform the spacing between the membrane and electrodes which contains the electrolyte. These spacers are generally manufactured from synthetic polymers which are chemically inert and which do not conduct electricity; they can be made in the form of interlaced, intertwined, knotted or welded yarns (e.g., woven fabrics, grids or nets), or they can be in the form of plates possessing holes or grooves. In practice, these spacers are oriented along planes which are parallel to those of the electrodes and the separating diaphragm.

Terephthalic acid reduction can be monitored to obtain 100% conversion. Less than 100% conversion is preferable. Less than 96% conversion is more preferable. High levels of undesirable by-products are produced at high conversion levels. Increased amounts of impurities such as dihydroxymethylbenzene and toluic acid can result at terephthalic acid conversion levels of greater than 95–96%. Percent conversion is preferably balanced to obtain maximum conversion to p-hydroxymethylbenzoic acid and minimum conversion to undesirable by-products; although, inevitably, undesirable amounts of such by-products are produced due to the process conditions.

Terephthalic acid, under ambient conditions being virtually insoluble in water, requires a weak base as a reactant to form a soluble salt in water. Examples of suitable weak bases are ammonia, methylamine and ethylenediamine, but any base can be used wherein a pH greater than 6.5, preferably within the range of greater than 7 to less than 10, more preferably from about 8.0 to 9.5, is obtained.

In the practice of the invented electrolysis process, a weak base such as ammonia and a salt such as an ammonium salt are added initially to the catholyte, the ammonia in a concentration sufficient to dissolve the terephthalic acid in the solvent, i.e., water, liquid ammonia, etc. but which is preferably water, and an ammonium salt to carry the current. After an initial period of operation, a monoammonium salt of terephthalic acid is added to maintain a basic condition sufficient to cause additions of terephthalic acid to dissolve, with a pH greater than 6.5 and most preferably with a pH within the range of about 8.0 to about 9.5, to insure complete solubility of the terephthalic acid. Concurrently with the addition of the monoammonium salt of terephthalic acid, a mercury compound, preferably a solvent-soluble mercury salt, is added to the catholyte in an amount sufficient to maintain operation of the process, to provide a minimum concentration of mercury metal ion of from about 5 to 1000 parts per million (ppm) expressed as the metal. Concentrations of mercury metal ions greater than 1000 ppm can be used if suitable. Examples of mercury salts soluble in aqueous solutions are mercuric acetate, mercuric bromide, mercuric chlorate, mercuric chloride, and mercuric cyanide. Mercuric acetate is preferred because of high solubility and easy availability.

At the end of the terephthalic acid electrolysis, the crude p-hydroxymethylbenzoic acid is transported to a second electrolysis cell for electrolysis of the 4-carboxybenzaldehyde impurity which has been produced during the terephthalic acid electrolysis. The 4-carboxybenzaldehyde electrolysis is performed in the same manner as is the terephthalic acid electrolysis except that the voltage is not greater than 4 volts. Quite suprisingly, the level of 4-carboxybenzaldehyde decreases significantly to a level as low as 500 parts per 1 million parts of p-HMBA.

At the end of the 4-carboxybenzaldehyde electrolysis, the purified p-hydroxymethylbenzoic acid is isolated from the electrolyte by known means, which optionally can be by the difference in water solubility between that of terephthalic acid and p-hydroxymethylbenzoic acid. Using this method, the catholyte is acidified and filtered hot, within a temperature range of from about 75° C. to about 150° C., to remove terephthalic acid. The p-hydroxymethylbenzoic acid is obtained by cooling the mother liquor, optionally after concentrating under reduced pressure. The cooling is carried out at temperatures below 40° C. and preferably below 25° C.; the degree of concentration and the cooling temperature naturally vary according to the degree of purity desired for the p-hydroxymethylbenzoic acid.

The process of the invention possesses numerous advantages in addition to the advantages of purifying crude p-hydroxymethylbenzoic acid in batch or continuous operation; it makes it possible to use catholyte solutions which facilitate workup and recovery of the p-hydroxymethylbenzoic acid; it allows electrolysis cells to be produced which are compact and easy to dismantle; it allows gases to be removed easily which are produced at the anode, especially oxygen, and are capable of causing high resistance between the electrodes due to gas bubbles; it makes it possible to use high current densities and to achieve easily the supply of electricity in series between the various elementary electrolysis cells in an assembly of several cells; it makes it possible to use cells with vertical electrodes. Finally, due to the constant geometrical shape of the preferred electrolysis cells, the anolyte and the catholyte can be circulated very rapidly, enabling lower concentrations of terephthalic acid to be employed and, as a result, better degrees of conversion can be obtained in continuous operation.

The following examples illustrate the invention. The chemical yields indicated are yields of p-hydroxymethylbenzoic acid relative to initial quantities of terephthalic acid present. Concentrations of solutions are expressed as the number of grams of solute per liter of solution.

EXAMPLE I

Batch reduction of terephthalic acid to p-hydroxymethylbenzoic acid was carried out in an electrolysis cell in the following manner. The cathode was electrically pure lead amalgamated with 99.9% pure mercury. The membrane was of sulfonated fluorocarbon polymer. In construction the two-compartment electrolysis cell comprised an inlet plate of polyvinylchloride (PVC) which was fitted to a second plate of the same size of lead amalgam which constituted the cathode. PVC inserts between the cathode plate and the semi-permeable membrane acted as spacers to separate the cathode and membrane sufficiently to permit catholyte flow. The anode was an electrically pure ½-inch titanium plate coated with platinum to a thickness of 250 micro-inches. Anode and membrane were separated by PVC spacers to permit the anolyte to flow through the cell. An external reservoir for the anolyte served as an oxygen gas separator. An external reservoir for the catholyte served as a hydrogen gas separator. In operation, electrolye was continuously pumped from the reservoir to the electrolysis cell and returned to the reservoir through a heat exchanger. Periodic additions of mercuric acetate ($Hg(Ac)_2$) were made each hour to the electrolysis cell during the course of the run.

Current density was controlled so as to maintain consumption of electricity slightly below the calculated quantity of 4 Faradays required for one equivalent weight of terephthalic acid.

An aqueous solution of 2% sulfuric acid, approximately 0.2 mols/liter of water, was used as the anolyte. The catholyte consisted of water, terephthalic acid, ammonia and a soluble ammonium salt, ammonium sulfate ($(NH_4)_2SO_4$). Terephthalic acid was added during electrolysis to maintain the reduction rate. Analyses of the catholyte were made periodically by liquid chromatography and calculated as mg/ml of electrolyte solution. The process of the instant invention reduced the level of 4-CBA by approximately 90% to less than 2000 parts from over 15,000 parts per million parts of p-HMBA in 40 minutes. Results are in Table I.

TABLE I

Reduction of 4-Carboxybenzaldehyde In Presence of p-HMBA Run No. 5995-13

| Sample No. | Run Minutes | Volts | Amps | TA Added g | Catholyte p-HMBA mg/ml | Catholyte 4-CBA mg/ml | Catholyte 4-CBA ppm* |
|---|---|---|---|---|---|---|---|
| 1 | — | — | — | 360 | — | — | |
| 3 | 60 | 7.8 | 120 | 140 | 26.1 | 3.05 | 116,800 |
| 5 | 120 | 7.8 | 120 | 120 | 49.7 | 2.37 | 47,800 |
| 7 | 180 | 7.8 | 120 | 60 | 65.6 | 1.89 | 28,800 |
| 9 | 240 | 7.8 | 120 | — | 77.3 | 1.43 | 18,500 |
| 10 | 260 | 7.8 | 120 | — | 79.6 | 1.26 | 15,850 |
| 11 | 270 | 5.8 | 60 | — | 81.2 | .74 | 9,110 |
| 12 | 280 | 4.5 | 30 | — | 79.8 | .39 | 4,900 |
| 13 | 300 | 4.0 | 10 | — | 79.6 | .14 | 1,760 |

Notes:
TA—terephthalic acid.
*Parts 4-CBA/million parts p-HMBA

EXAMPLE II

In the procedure of Example I an additional run was made. The electrolyte was ammonium carbonate, $(NH_4)_2CO_3$. The choice of electrolyte did not affect the reduction of 4-CBA to p-HMB. The level of 4-CBA in the catholyte was decreased to less than 500 parts per million parts of p-HMBA, a decrease of about 85% in 90 minutes, from 5450 ppm to 469 ppm. Results are in Table II.

TABLE II

Reduction of 4-CBA In Presence of p-HMBA Run No. 6234-36

| Sample No. | Minutes | Volts | Amps | Catholyte p-HMBA mg/ml | Catholyte 4-CBA mg/ml | Catholyte 4-CBA ppm* |
|---|---|---|---|---|---|---|
| 1 | — | — | — | — | — | — |
| 2 | 60 | 8.3 | 120 | 183.7 | 2.28 | 12,400 |
| 5 | 206 | 7.6 | 120 | 190.0 | 2.12 | 11,150 |
| 6 | 236 | 6.1 | 90 | 204.1 | 1.21 | 5,910 |

TABLE II-continued

Reduction of 4-CBA In Presence of p-HMBA Run No. 6234-36

| Sample No. | Minutes | Volts | Amps | Catholyte p-HMBA mg/ml | Catholyte 4-CBA mg/ml | Catholyte 4-CBA ppm* |
|---|---|---|---|---|---|---|
| 7 | 260 | 6.1 | 90 | 193.9 | 1.05 | 5,450 |
| 8 | 290 | 4.5 | 36 | 197.0 | .23 | 1,164 |
| 9 | 320 | 4.0 | 21 | 193.6 | — | — |
| 10 | 350 | 3.5 | 8 | 192.2 | .09 | 469 |

*Parts 4-CBA/million parts p-HMBA

What is claimed is:

1. A process for preparation of p-hydroxymethylbenzoic acid by conversion of terephthalic acid wherein 4-carboxybenzaldehyde content is decreased to low levels which comprises electrochemical reduction of terephthalic acid in a two-compartment electrolysis cell with a suitable membrane in which (a) the cathode is solid and metal with a mercury overlay as an amalgam surface and has a hydrogen overvoltage which is greater than the potential for the reduction of terephthalic acid to p-hydroxymethylbenzoic acid, (b) sufficient mercury is added as a mercury compound to maintain the process, (c) the reduction of terephthalic acid to p-hydroxymethylbenzoic acid is performed at a voltage of about at least 6 volts with current efficiency being maintained at a level of at least 80%, and (d) reduction of 4-carboxybenzaldehyde is performed at a voltage not greater than 4 volts.

2. The process of claim 1 wherein (a) said two compartments of said cell are separated by a cation exchange diaphragm, (b) the catholyte of said cell comprises a solvent, terephthalic acid, ammonia, an ammonium salt and a soluble salt of mercury, (c) the temperature of the catholyte is between 0° C. and 100° C., (d) the concentration of the mercury ions of said soluble salt of mercury is within the range of 5 to 500 ppm wherein cathode activity is maintained by continuous addition of mercuric acetate to maintain said concentration of said mercury ions, (e) the current density is within the range of 1 to 200 $A/dm^2$.

3. The process of claim 2 wherein said solvent is water.

4. The process of claim 2 wherein said soluble salt of mercury is mercuric acetate.

5. The process of claim 2 wherein said cation exchange diaphragm is of the homogeneous type.

6. The process of claim 5 wherein said diaphragm is a membrane of perfluorosulfonic acid.

7. The process of claim 2 wherein said ammonium salt of said catholyte is selected from the group consisting of ammonium chloride, ammonium sulfate and ammonium carbonate.

8. The process of claim 2 wherein concentration of said terephthalic acid is greater than 2% by weight of the total solution.

9. The process of claim 2 wherein concentration of said ammonium salt is within the range of from about 0.1 to about 10% by weight of the total solution.

10. The process of claim 9 wherein concentration of said ammonium salt is within the range of from about 0.1 to about 1.0% by weight of the total solution.

11. The process of claim 2 wherein concentration of said ammonia as ammonium hydroxide is within the range of from about 1 gram of ammonium hydroxide per 2 grams of terephthalic acid to about 1 gram of ammonium hydroxide per gram of terephthalic acid and wherein the pH of the resulting solution is at least 6.5.

12. The process of claim 11 wherein said pH of resulting solution is from about greater than 7.0 to less than 10.0.

13. The process of claim 12 wherein said pH of resulting solution is within the range of from about 8.0 to about 9.5.

14. The process of claim 13 wherein said terephthalic acid conversion to p-hydroxymethylbenzoic acid is less than 96%.

15. The process of claim 1 wherein said metal of said cathode is selected from the group consisting of lead, and alloys of lead with metals selected from the group consisting of cadmium, antimony, tin and bismuth.

16. The process of claim 15 wherein said metal of said cathode is lead and surface of said cathode is lead amalgam.

17. The process of claim 1 wherein current density is within the range of from about 85 to about 100 $A/dm^2$.

18. The process of claim 1 wherein terephthalic acid conversion to p-hydroxymethylbenzoic acid is less than 100%.

19. The process of claim 1 wherein said p-hydroxymethylbenzoic acid is isolated from the catholyte by acidification of said catholyte, filtration of said catholyte at a temperature within the range of from about 75° C. to about 150° C. to remove terephthalic acid, and cooling the mother liquor at a temperature below 40° C.

20. The process of claim 1 wherein said process is a continuous process.

* * * * *

UNITED STATES PATENT OFFICE
CERTIFICATE OF CORRECTION

Patent No. 4 402 805 Dated September 6, 1983

Inventor(s) John A. Donohue

It is certified that error appears in the above-identified patent and that said Letters Patent are hereby corrected as shown below:

Patent reads (Col. 2, line 11) "acisd"
and should read --acid--

Patent reads (Col. 2, line 37) "for producing of"
and should read --for production of--

Patent reads (Col. 7, line 54) "to p-HMB"
and should read --to p-HMBA--

Signed and Sealed this

First Day of May 1984

[SEAL]

*Attest:*

GERALD J. MOSSINGHOFF

*Attesting Officer*

*Commissioner of Patents and Trademarks*